United States Patent [19]

Ahn et al.

[11] 4,062,743

[45] Dec. 13, 1977

[54] ELECTROLYTIC PROCESS FOR POTASSIUM HYDROXIDE

[76] Inventors: Byung K. Ahn; Ronald L. Dotson, both of Cleveland, Tenn.

[21] Appl. No.: 680,702

[22] Filed: Apr. 27, 1976

Related U.S. Application Data

[63] Continuation-in-part of Ser. No. 643,264, Dec. 22, 1975.

[51] Int. Cl.[2] ..... C25B 1/16; C25B 1/26

[52] U.S. Cl. ..... 204/98; 204/128

[58] Field of Search ..... 204/98, 128, 296

[56] References Cited

U.S. PATENT DOCUMENTS 3,773,634 11/1973 Stacey et al. ..... 204/98

3,897,320 7/1975 Cook ..... 204/98

3,954,579 5/1976 Cook et al. ..... 204/98

*Primary Examiner*—R. L. Andrews

*Attorney, Agent, or Firm*—James B. Haglind; Donald F. Clements; Thomas P. O'Day

[57] ABSTRACT

Current efficiency in an electrolytic membrane cell for the production of potassium hydroxide from aqueous solutions of KCl is considerably increased by maintaining the anolyte concentration of KCl at 250–350 grams per liter and the catholyte concentration of KOH at from about 410 to about 480 grams per liter. The electrolytic cell employs a cationic permselective membrane comprised of a hydrolyzed copolymer of a perfluoroolefin and a fluorosulfonated perfluorovinyl ether.

9 Claims, 1 Drawing Figure

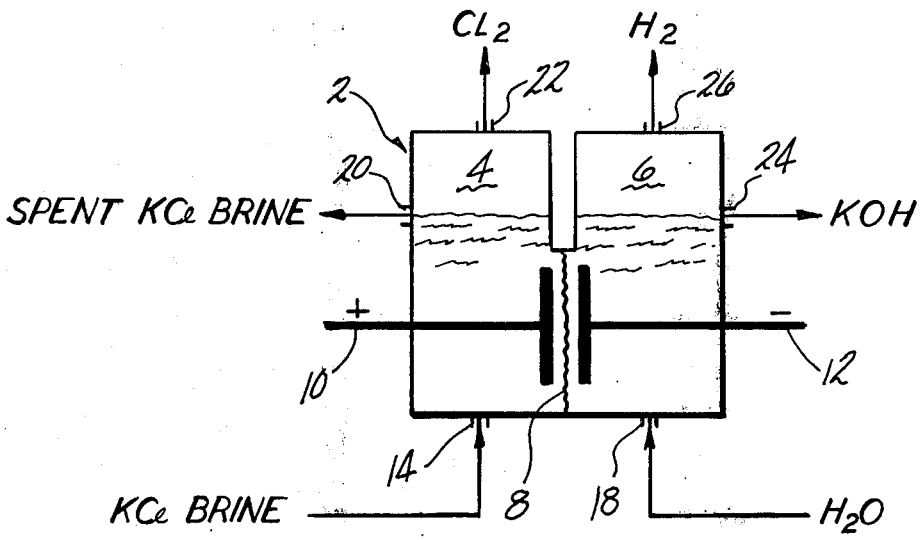
$Cl_2$
$H_2$
2
22
26
20
4
6
24
SPENT KCl BRINE
KOH
+
−
10
12
14
8
18
KCl BRINE
$H_2O$

ELECTROLYTIC PROCESS FOR POTASSIUM HYDROXIDE

This application is a continuation-in-part of U.S. application Ser. No. 643,264 filed Dec. 22, 1975.

This invention relates to a process for the production of chlorine and potassium hydroxide. Potassium hydroxide is used in the manufacture of soft soap, alkaline batteries, and in the production of textiles and the fabrication of rubber.

Commercially potassium hydroxide is produced in electrolytic cell employing asbestos diaphragms as a product liquor containing 10–15 percent KOH and about 10 percent KCl. The liquor is concentrated by evaporation while crystallizing out KCl to provide a concentrated solution containing about 45 percent KOH and containing about 1 percent KCl.

Recently polymeric materials having ion exchange properties, have been produced which may be employed as membranes in electrolytic cells. During the electrolysis of alkali metal chlorides, alkali metal hydroxides having increased concentration and reduced alkali metal chloride content can be obtained with membranes of these polymeric materials.

A particularly suitable membrane can be fabricated from a cation permselective membrane comprised of a hydrolized copolymer of a perfluoroolefin and a fluorosulfonated perfluorovinyl ether, sold under the trademarks of "XR" or "Nafion" perfluorosulfonic acid membranes by E. I. duPont de Nemours and Company.

U.S. Pat. No. 3,773,634, issued to A. J. Stacey and R. L. Dotson, describes a process for electrolyzing aqueous sodium chloride having a concentration in the range of 120–250 grams per liter in the anolyte to produce sodium hydroxide where the concentration is held in the range of 31–43 percent. When, however, the concentration of sodium chloride in the anolyte is in excess of 250 grams per liter, the caustic concentration became unstable and there is a continuous increase in caustic concentration. This increasing concentration, however, is accompanied by decreased current efficiency. The cell employs hydraulically impervious cation-permselective membranes such as the perfluorosulfonic acid membranes produced by the duPont Company.

It is also known that the use of hydraulically impervious cation-permselective membranes in the electrolysis of alkali metal chloride brines creates an area at the anolyte-membrane interface which promotes the formation of chlorate because of increased hydroxyl ion back migration.

There is need therefore for an electrolytic membrane process for producing potassium hydroxide at high concentrations with improved current efficiencies using concentrated potassium chloride.

It is an object of the present invention to provide a process for producing chlorine gas and potassium hydroxide with reduced energy costs.

An additional object of the present invention is a process for producing chlorine gas and potassium hydroxide having improved product yield.

Another object of the present invention is a process for producing chlorine gas and potassium hydroxide as highly concentrated products.

A further object of the present invention is a process for producing chlorine gas and potassium hydroxide of high purity.

These and other objects of the invention are accomplished in a process for producing chlorine gas and potassium hydroxide by the electrolysis of an aqueous solution of potassium chloride in an electrolytic cell having an anode compartment containing an anode and a cathode compartment containing a cathode, the process comprising:

a. separating said anode compartment from said cathode compartment with a cation permselective membrane comprised of a hydrolyzed copolymer of a perfluoroolefin and a fluorosulfonated perfluorovinyl ether of the formula $FSO_2CFRCF_2O[CFYCF_2O]_nCF=CF_2$, where R is a radical selected from the group consisting of fluorine and perfluoroalkyl radicals having from 1 to about 8 carbon atoms; Y is a radical selected from the group consisting of fluorine and trifluoromethyl; and $n$ is an integer of 0 to about 3, said hydrolyzed copolymer having an equivalent weight of from about 900 to about 1600,
b. introducing an aqueous solution of potassium chloride containing from about 250 to about 350 grams per liter of KCl into the anode compartment,
c. impressing an electrolyzing current between the anode and the cathode to produce chlorine gas in the anode compartment and an aqueous solution of potassium hydroxide in the cathode compartment,
d. maintaining the concentration of the aqueous solution of potassium hydroxide at from about 410 to about 480 grams per liter of KOH in the cathode compartment.

The accompanying FIGURE represents a schematic view of an electrolytic membrane cell used for employing the process of the present invention.

Membrane cell 2 is divided into an anode compartment 4 and a cathode compartment 6 by cationic permselective membrane 8. Anode 10 is located in anode compartment 4 and cathode 12 is positioned in cathode compartment 6. A potassium chloride brine is fed through inlet 14 into anode compartment 4. An electric current is applied to anode 10 to electrolytically decompose the potassium chloride brine into chloride ions, which form chlorine gas at the anode, and potassium ions.

Cationic perselective membrane 8 permits potassium ions and water to pass through to cathode compartment 6 while preventing the passage of chloride ions or chlorine gas bubbles. Water is introduced into cathode compartment 6 through inlet 18. To maintain high anodic current efficiency spent chloride brine is continuously removed from anode compartment 4 through outlet 20. Chlorine gas is removed from anode compartment 4 through outlet 22. An aqueous solution of potassium hydroxide is obtained through outlet 24 in cathode compartment 6. Gaseous hydrogen is removed from cathode compartment 6 through outlet 26.

The cationic permselective membrane which separates the anode compartment from the cathode compartment is composed of a material which is fluid permeable and halogen resistant. A suitable cationic permselective membrane is comprised of a solid fluorocarbon polymer reinforced by a screen of a suitable metal or a fabric such as a polyfluoroolefin cloth. The solid fluorocarbon polymers are preferably hydrolyzed copolymers of a perfluoroolefin and a fluorosulfonated perfluorovinyl ether. Suitable perfluoroolefins include tetrafluoroethylene, hexafluoropropylene, octafluorobutylene and higher homologues. Preferred perfluoroolefins include tetrafluoroethylene and hexafluoropropylene, with tetrafluoroethylene being particularly preferred. The fluorosulfonated perfluorovinyl ethers are compounds of the formula $FSO_2CFRCF_2O[CFYCF_2O]_nCF{=}CF_2$(I), where R is a radical selected from the group consisting of fluorine and perfluoroalkyl radicals having from 1 to about 8 carbon atoms, Y is a radical selected from the group consisting of fluorine and trifluoromethyl radicals; and *n* is an integer of 0 to about 3. Illustrative of such fluorosulfonated perfluorovinyl ethers are:

$FSO_2CF_2CF_2OCF{=}CF_2$, $FSO_2CF_2CF_2OCF(CF_3)CF_2OCF(CF_3)CF_2OCF{=}CF_2$, $FSO_2CF_2CF_2CF_2CF_2OCF(CF_3)CF_2OCF{=}CF_2$, and $FSO_2CF_2CF_2OCF(CF_3)\ CF_2OCF{=}CF_2$.

Preferred sulfonated perfluorovinyl ethers are those of formula I above in which R is fluorine and Y is trifluoromethyl.

A particularly preferred sulfonated perfluorovinyl ether is that of the formula:

$FSO_2CF_2CF_2OCF(CF_3)CF_2OCF{=}CF_2$, perfluoro[2-(2-fluorosulfonylethoxy) propyl vinyl ether].

The sulfonated perfluorovinyl ethers are prepared by method described in U.S. Pat. Nos. 3,041,317 to Gibbs et al.; 3,282,875 to Connolly et al.; 3,560,568 to Resnick; and 3,718,627 to Grot.

The copolymers employed in the cationic permselective membrane of the present invention are prepared by methods described in U.S. Pat. Nos. 3,041,317 to Gibbs et al.; 3,282,875 to Connolly et al.; and 3,692,569 to Grot.

The solid fluorocarbon polymers are prepared by copolymerizing the perfluoroolefin, for example, tetrafluoroethylene with the sulfonated perfluorovinyl ether followed by converting the $FSO_2$ group to $SO_3H$ or a sulfonate group (such as an alkali metal sulfonate) or a mixture thereof. The equivalent weight of the perfluorocarbon copolymer ranges from about 900 to about 1600, and preferably from about 1100 to about 1500. The equivalent weight is defined as the average molecular weight per sulfonyl group.

A particularly preferred cation permselective membrane is a perfluorocarbon polymer composite membrane produced by E. I. DuPont de Nemours and Co. and sold commercially under the trademark "Nafion".

The potassium chloride brine used in producing potassium hydroxide is a concentrated aqueous solution containing from about 250 to about 350 and preferably, from about 270 to about 350 grams per liter of KCl.

As shown in the Figure, in one embodiment of the process of the present invention, the weak KCl solution may be removed from the cell after partial depletion by electrolysis. The brine may be resaturated to the desired chloride concentration and then recycled to the cell. The aqueous solution of potassium chloride in the anode compartment is maintained at a concentration of from about 250 to about 350, and preferably at from about 260 to about 320 grams per liter of KCl.

An aqueous solution of potassium hydroxide is produced in the cathode compartment. The concentration of the solution is maintained at from about 410 to about 480 preferably at from about 420 to about 470, and more preferably at from about 430 to about 460 grams per liter of KOH. To initially obtain this concentration, the cell may be operated until the desired concentration is reached or alternately an aqueous solution of potassium hydroxide of the desired concentration may be introduced into the cathode compartment before starting the electrolysis. In a preferred embodiment, the KOH concentration is maintained within the desired range by introducing water into the cathode compartment at a rate of about 0.05 to about 0.1 liters per minute per kiloampere per square meter of cathode surface. The amount of water added is related to controlling the concentration of the potassium hydroxide in the catholyte, which, in turn, determines the ion transport properties of the membrane.

The potassium hydroxide is a highly pure product containing only minor amounts of potassium chloride as an impurity (less than 1.2 grams per liter).

The electrolysis of the alkali metal chloride brine is conducted at current densities of from about 1 to about 5, and preferably at from about 2 to about 4 kiloamperes per square meter of anode working surface.

Chlorine gas produced in the anode compartment and hydrogen gas produced in the cathode compartment are recovered by methods well known to the prior art.

Any suitable electrodes may be used as the anode or cathode in the electrolytic membrane cell. Typical anodes are those of graphite or a foraminous metal such as titanium or tantalum having an electroactive coating over at least a portion of the anode surface. Suitable coatings include those of a platinum group metal, platinum group metal oxide, an alloy of a platinum group metal or mixtures thereof. The term "platinum group metal" means an element of the group consisting of ruthenium, rhodium, platinum, palladium, osmium, and iridium.

Cathodes which may be employed include foraminous structures of metals such as steel or nickel.

The process of the present invention is further illustrated by the following example. All parts and percentages are given by weight unless otherwise specified.

EXAMPLE

An electrolytic cell of the type shown in the FIGURE had an anode compartment containing an anode comprised of a titanium mesh coated with electroactive ruthenium dioxide. A cation permselective membrane, comprised of Nafion ® 427 membrane (E. I. DuPont de Nemours & Co.) 7 mils in thickness and having an equivalent weight of 1200 and supported by a layer of polytetrafluoroethylene cloth, separated the anode compartment from the cathode compartment. A stainless steel mesh cathode was housed in the cathode compartment adjacent to the cation permselective membrane. Potassium chloride, ca 300–310 grams per liter, was passed through an inlet into the anolyte compartment at a rate of 1.6 liters per minute per square meter of anode surface and maintained inside the cell at a temperature of about 80°–90° C. The pH of the anolyte solution was determined to be about 2.1–4.5 depending on the KOH concentration in the catholyte. Current was passed through the cell to provide a current density of 2 kiloamperes per square meter. Chlorine gas was generated at the anode and hydrogen gas generated at the surface of the cathode. Spent potassium chloride was removed from the anode compartment at a rate which maintained the concentration of the spent KCl in the range of about 250–300 grams per liter. Water was fed to the cathode compartment initially at a rate of about 0.4 and reduced to about 0.15 liters per minute per square meter of cathode surface as the concentration of potassium hydroxide increased. Potassium hydroxide produced in the cathode compartment was removed, the concentration determined periodically and the cathode current efficiency calculated. The current efficiency remained constant at concentrations of KOH of from about 275 grams per liter to about 400 grams per liter. Using concentrated KCl feed to the anolyte, a rapid rise in current efficiency was found at a concentration of KOH of about 410 grams per liter with an equally rapid decline in current efficiency at KOH concentrations above about 480 grams per liter, as shown in Table 1 below.

TABLE 1

| Electrolysis of KCl at a Current Density of 2KA/m² | |
|---|---|
| Catholyte Concentration of KOH (grams per liter) | Cathode Current Efficiency |
| 325 | 80 |
| 350 | 80 |
| 400 | 80 |
| 425 | 84 |
| 440 | 87 |
| 465 | 86 |
| 475 | 84 |
| 485 | 80 |

The above example shows that a dramatic increase in current efficiency occurred in the KOH concentration range of from about 425 to about 475 grams per liter. This unexpected increase in current efficiency could not be predicted from available information concerning the electrolysis of potassium chloride solutions.

What is claimed is:

1. A process for the production of chlorine gas and potassium hydroxide by the electrolysis of an aqueous solution of potassium chloride in an electrolytic cell having an anode compartment containing an anode and a cathode compartment containing a cathode, said process comprising:

a. separating said anode compartment from said cathode compartment with a cation permselective membrane comprised of a hydrolyzed copolymer of a perfluoroolefin and a fluorosulfonated perfluorovinyl ether of the formula $$FSO_2CFRCF_2O[CFYCF_2O]_n CF{=}CF_2$$

where R is a radical selected from the group consisting of fluorine and perfluoroalkyl radicals having from 1 to about 8 carbon atoms; Y is a radical selected from the group consisting of fluorine and trifluoromethyl; and $n$ is an integer of 0 to about 3, said hydrolyzed copolymer having an equivalent weight of from about 900 to about 1600, b. introducing said aqueous solution of said potassium chloride containing from about 250 to about 350 grams per liter of KCl into said anode compartment, c. impressing an electrolyzing current between said anode and said cathode to produce chlorine gas in said anode compartment and an aqueous solution of potassium hydroxide in said cathode compartment, d. maintaining the concentration of said aqueous solution of potassium hydroxide at from about 410 to about 480 grams per liter of KOH in said cathode compartment.

2. The process of claim 1 in which water is introduced into said cathode compartment to maintain said concentration of said aqueous solution of said potassium hydroxide.

3. The process of claim 2 in which said R is a fluorine radical and said Y is a trifluoromethyl radical.

4. The process of claim 3 in which said perfluoroolefin is tetrafluoroethylene and said fluorosulfonated perfluorovinyl ether is $$FSO_2CF_2CF_2OCF(CF_3)CF_2OCF{=}CF_2.$$

5. The process of claim 4 in which said hydrolyzed copolymer of said perfluoroolefin and said fluorosulfonated perfluorovinyl ether has an equivalent weight of from about 1100 to about 1500 and said hydrolyzed copolymer is reinforced by a polytetrafluoroethylene cloth.

6. The process of claim 5 in which said concentration of said aqueous solution of potassium hydroxide is maintained at from about 420 to about 470 grams per liter of KOH.

7. The process of claim 2 in which said aqueous solution of potassium chloride is continuously added and spent potassium chloride is continuously removed, said aqueous solution of potassium chloride in said anode compartment being maintained at from about 260 to about 320 grams per liter of KCl.

8. The process of claim 7 in which said water is introduced into said cathode compartment at a rate of from about 0.05 to about 0.1 liters per minute per kiloampere per square meter of cathode surface.

9. The process of claim 8 in which said concentration of said aqueous solution of potassium hydroxide is maintained at from about 430 to about 460 grams per liter of KOH.

* * * * *

UNITED STATES PATENT OFFICE

CERTIFICATE OF CORRECTION

Patent No. 4,062,743 Dated December 13, 1977

Inventor(s) Byung K. Ahn and Ronald L. Dotson

It is certified that error appears in the above-identified patent and that said Letters Patent are hereby corrected as shown below:

On the front page of the patent, between "[76] Inventors: Byung K. Ahn; Ronald L. Dotson, both of Cleveland, Tenn. and [21] Appl. No.: 680,702" insert --[73] Assignee: Olin Corporation, New Haven, Conn.--.

In Column 3, line 25, delete "method" and insert --methods--.

Signed and Sealed this

*Twenty-second* Day of *August 1978*

[SEAL]

*Attest:*

RUTH C. MASON
*Attesting Officer*

DONALD W. BANNER
*Commissioner of Patents and Trademarks*